US011305907B2

(12) United States Patent
Schütte

(10) Patent No.: US 11,305,907 B2
(45) Date of Patent: Apr. 19, 2022

(54) FILLING MACHINE FOR FILLING OPEN BAGS WITH BULK MATERIAL AND CLEANING DEVICE

(71) Applicant: HAVER & BOECKER OHG, Oelde (DE)

(72) Inventor: Volker Schütte, Oelde (DE)

(73) Assignee: HAVER & BOECKER OHG, Oelde (DE)

( * ) Notice: Subject to any disclaimer, the term of this patent is extended or adjusted under 35 U.S.C. 154(b) by 168 days.

(21) Appl. No.: 16/611,812

(22) PCT Filed: May 8, 2018

(86) PCT No.: PCT/EP2018/061921

§ 371 (c)(1),
(2) Date: Nov. 7, 2019

(87) PCT Pub. No.: WO2018/206602

PCT Pub. Date: Nov. 15, 2018

(65) Prior Publication Data

US 2020/0062434 A1 Feb. 27, 2020

(30) Foreign Application Priority Data

May 8, 2017 (DE) ..... 102017109873.9

(51) Int. Cl.
*B65B 55/24* (2006.01)
*B08B 9/087* (2006.01)
(Continued)

(52) U.S. Cl.
CPC ..... *B65B 55/24* (2013.01); *B08B 9/087* (2013.01); *B08B 9/093* (2013.01); *B65B 1/02* (2013.01);
(Continued)

(58) Field of Classification Search
CPC .. B65B 55/24; B65B 1/06; B65B 1/24; B65B 1/26; B08B 9/093
See application file for complete search history.

(56) References Cited

U.S. PATENT DOCUMENTS 10,960,415 B1 * 3/2021 Amato ..... B08B 9/0936
2015/0151340 A1 * 6/2015 Eck ..... B08B 9/20 134/115 R (Continued)

FOREIGN PATENT DOCUMENTS

EP 1403187 A1 3/2004

OTHER PUBLICATIONS

International Search Report from International Patent Application No. PCT/EP2018/061921, dated Jul. 17, 2018.

*Primary Examiner* — Anna K Kinsaul
*Assistant Examiner* — Himchan Song
(74) *Attorney, Agent, or Firm* — Greer, Burns & Crain, Ltd

(57) ABSTRACT

A filling machine for filling open-mouth bags with bulk material wherein the open-mouth bag is at least temporarily received in a container with a cleaning apparatus, and a cleaning apparatus for cleaning a tubular inner wall of the container e.g. from particles of bulk material, the cleaning apparatus including a cleaning device that is movable in the container in a longitudinal direction. The cleaning device has a laminate of a multitude of layers. The layers extend transverse to the longitudinal direction and the laminate includes two end layers having one end face each. One end layer is configured as a top layer with a top surface and one end layer, as a bottom layer with a bottom surface. The laminate is configured with a plurality of outwardly oriented fluid outlet ports for directing a fluid flow toward the tubular inner wall of the container.

21 Claims, 5 Drawing Sheets

(51) Int. Cl.

| | |
|---|---|
| ***B08B 9/093*** | (2006.01) |
| ***B65B 1/06*** | (2006.01) |
| ***B65B 1/24*** | (2006.01) |
| ***B65B 1/26*** | (2006.01) |
| ***B65B 43/44*** | (2006.01) |
| ***B65B 1/02*** | (2006.01) |
| ***B65B 43/46*** | (2006.01) |

(52) U.S. Cl.
CPC ..... *B65B 1/06* (2013.01); *B65B 1/24* (2013.01); *B65B 1/26* (2013.01); *B65B 43/44* (2013.01); *B65B 43/465* (2013.01)

(56) References Cited

U.S. PATENT DOCUMENTS

| | | | |
|---|---|---|---|
| 2017/0275032 | A1 | 9/2017 | Vollenkemper et al. |
| 2017/0291727 | A1 | 10/2017 | Vollenkemper et al. |

* cited by examiner

FILLING MACHINE FOR FILLING OPEN BAGS WITH BULK MATERIAL AND CLEANING DEVICE

BACKGROUND

The present invention relates to a filling machine for filling open-mouth bags with bulk material comprising a cleaning apparatus, and a cleaning apparatus for cleaning the tubular inner wall of a container e.g. of bulk material particles or other contaminants.

In WO 2016/046302 A1 the prior art has disclosed an apparatus and a method for filling open-mouth bags, this known apparatus showing a fill weight of a filled open bag between approximately 1 kg to 10 kg. The known apparatus in particular fills bulk materials such as cement or high-quality tile grout or other construction materials into open-mouth bags, which are also referred to as bags or pouches. The known apparatus allows to directly manufacture the bags in a device upstream of the apparatus in the scope of the filling process. To this end for example a flat sheet is pulled over a shaping shoulder where the flat sheet is welded together to obtain a tubular film. The known apparatus receives the open-mouth bag intended for filling in a receiving box where it is filled. The known apparatus provides for filling box-shaped open-mouth bags which are compacted during the process. At the end of the process block-shaped open-mouth bags can be packaged. The known apparatus operates satisfactorily.

When manufacturing the open-mouth bags the open-mouth bags are inserted into a receiving box where they are filled, optionally recompacted and then discharged. During inserting, recompacting and also in discharging, bulk material particles may adhere to the inner container wall, or dust may scratch the surface of the open-mouth bag. A printed bag surface may be scratched or turn shabby.

It is therefore the object of the present invention to provide a filling machine for filling open-mouth bags with bulk material and a cleaning apparatus allowing the filling of high quality open-mouth bags with bulk material and wherein damage to e.g. printed surfaces of an open-mouth bag can be avoided better.

SUMMARY

A filling machine according to the invention serves to fill open-mouth bags with bulk material wherein the open-mouth bag is at least temporarily received in a container. At least one cleaning apparatus is comprised for cleaning particles of bulk material for example or in particular off the tubular inner wall of a container so as to clean the tubular inner wall after or during discharge and/or prior to inserting or while inserting an open-mouth bag. The cleaning apparatus comprises a cleaning device that is movable in the container in a longitudinal direction (of the inner wall). The cleaning device comprises a laminate of a multitude of (at least 2) layers or plates. The laminate comprises two end layers having one end face each. One end layer is configured as a top layer with a top surface and one end layer, as a bottom layer with a bottom surface. The laminate shows a plurality of outwardly oriented fluid outlet ports for directing a fluid flow toward the tubular inner container wall.

The filling machine according to the invention has many advantages. A considerable advantage of the filling machine according to the invention is that after filling, any particles adhering to the container can be cleaned off through the fluid outlet ports in the laminate. The fluid outlet ports can be oriented in the desired direction and desired quantity toward the tubular inner container wall. This allows to match the strength and intensity and orientation of the fluid flow toward the tubular inner container wall, to the desired conditions to clean off any interfering adhering particles which might scratch, damage or contaminate the surface of an open-mouth bag during a subsequent filling process. Specifically in the field of consumer products it is highly desirable to provide optically faultless and clean packages.

In advantageous configurations at least one layer is configured as a (separate) plate. The laminate may be a composite of multiple (separate) layers and/or plates. The laminate may be configured as a plate composite. At least one end layer may be configured as an end plate providing a top layer or end face.

The plates and/or layers preferably extend transverse to the longitudinal direction. In particular in the case of additive manufacturing (also called 3D printing) the layers may also extend in the longitudinal direction or oblique to the longitudinal direction.

The plate composite in particular comprises two end layers having one end face each, one end layer being configured as a top layer with a top surface and one end layer, as a bottom layer with a bottom surface.

Particularly preferably the entire cleaning apparatus or at least the cleaning device is displaceable in height for cleaning the tubular inner container wall.

In advantageous configurations the fluid employed is air. Then the fluid outlet ports are air outlet ports and may be referred to as blowout holes. A plurality of blowout holes is in particular provided or configured over the circumference of at least one of the layers or plates of the layer composite or plate composite.

The fluid flow is suitable for cleaning an inner tube wall of a tubular container. The tubular container may be configured as a receiving box. The fluid flow in particular enables to blow bulk material particles off the inner tube wall. It is a considerable advantage that any desired tube cross section can be effectively cleaned. Multiple fluid outlet ports having small cross sections are advantageous, allowing high fluid outlet speeds with low fluid consumption (air consumption) and good cleaning effects including the corners.

Preferably the laminate is movable along a longitudinal direction of the tubular inner wall, which may also be referred to as axial direction. The fluid outlet ports (outlet ports) are oriented transverse and may for example be oriented radially. It is likewise possible for the orientation of the fluid outlet ports to also include an axial component.

In a preferred specific embodiment at least one fluid feed is connected with an end layer and in particular the bottom layer or bottom plate. To this end, in particular a fluid feed port is configured on the (axial) end face. A fluid line such as a hose or the like is preferably connected to the fluid feed port.

In preferred specific embodiments, fluid outlet ports are configured on a peripheral surface and/or at least one end face of the laminate and/or plate composite. Air outlet ports are particularly preferably disposed or configured distributed over the circumference of the laminate.

Particularly preferably the laminate comprises at least one fluid guiding layer (in particular an air guiding layer or air baffle), in which a multitude of (air) guiding ducts coupled with fluid outlet ports is configured. The fluid guiding layer is in particular configured as a fluid baffle. In a simple configuration the guiding ducts are configured on or in the fluid guiding layer separated from one another by material bridges. A guiding duct and in particular all the guiding ducts extend in particular from a radially inwardly region outwardly up to the outwardly edge of the fluid guiding layer. Preferably at least two guiding ducts extend from one radially farther inwardly guiding duct front end to one fluid outlet port each. In preferred configurations two guiding ducts do not intersect. The guiding ducts are in particular configured (approximately) star-shaped. It is also possible for the guiding ducts to be configured in a spiral in the fluid guiding layer (so that in particular they do not intersect).

Preferably two guiding ducts each extend from a radially further inwardly guiding duct front end to one fluid outlet port each.

In all the configurations the guiding ducts may be inserted by machining and in particular by punching, laser machining, etching or e.g. by water jet cutting.

In advantageous specific embodiments the laminate includes a distance layer or distance plate adjacent to the fluid guiding layer. The distance layer is in particular received between a top layer and the fluid guiding layer.

In preferred configurations the laminate shows a distributor trough configured in the shape of a distributor chamber. The distributor trough connects at least two guiding duct front ends (and in particular all the guiding duct front ends) with one another. The distributor trough is in particular configured in a central region of the laminate. The distributor trough allows to simultaneously supply multiple guiding ducts with fluid by way of supplying fluid to the distributor trough.

The distributor trough may be formed by a through hole in the distance layer plate. Then the distributor trough in the distance layer causes concurrent supply of the guiding duct front ends of different guiding ducts. This is why in particularly preferred configurations the distributor trough is connected with the fluid feed. The fluid guiding layer may include a central through hole.

The fluid may be fed to the distributor trough for example through the central through hole.

In advantageous configurations a drive is provided for moving the laminate along a longitudinal direction of the tubular inner container wall. The drive is in particular an electric drive. It is likewise possible to employ a pneumatic or hydraulic or other type of drive.

In all the configurations the laminate may be configured with at least one, in particular separate, supply feed-through. The supply feed-through may for example be provided for feeding a fluid line or a vacuum line or a current connection or the like through the laminate. A separate supply feed-through in this sense is at least one supply line fed through the laminate independently of the guiding ducts and the fluid outlet ports. This means that feeding fluid through the supply feed-through does not show any effect on fluid exiting the fluid outlet ports. Except if the supply feed-through in turn serves as a fluid supply. The fluid outlet ports are preferably disposed close to the tubular inner wall. Then there is no space left for supply lines between the inner tube wall and the cleaning device.

Brushes are preferably affixed to an outside surface of the laminate, in particular for cleaning the tubular inner wall (at least in sections). Brushes may be provided over the entire circumference of the laminate or plate composite. It is also possible to attach brushes only in specific regions or sections in which additional mechanical cleaning is advantageous.

In all the configurations it is preferred for at least one centering hole to be formed on at least one layer of the laminate in which a centering pin is received. It is possible and preferred for two centering holes to be configured into each of which one centering pin is inserted to ensure defined installation of the laminate.

In all the configurations it is preferred for at least one plate of the laminate to consist at least substantially and in particular nearly entirely, or entirely, of metal and in particular steel.

In all the configurations it is preferred for the cross section of the laminate to be adapted to the inner cross section of the container. This cross section may be for example round, rounded, oval, rectangular or star-shaped or showing counterdrafts or undercuts or the like. The lateral dimensions of the laminate and/or of the plate composite are in particular matched to the inner dimensions of the container so as to obtain a defined (minimum and maximum) distance from the inner container walls.

In all the cases a sealant or a sealing layer may be provided between individual or all the layers of the laminate.

Seal inserts may be used. Sealants may also be coated or sprayed on. Sealants may be dispensed with depending on the surface condition.

Furthermore the present invention relates to a compaction station showing at least one compacting device for compacting open-mouth bags filled with bulk materials. The invention is used in particular in conjunction with a filling machine or apparatus as it has been disclosed in WO 2016/046302 A1. In such a known apparatus bags are filled for example with bulk materials such as cement, high-quality tile grout or other construction materials. Block-shaped bags showing a high compaction degree are manufactured.

However, if the open-mouth bags filled with bulk materials are handled by many persons or if too much pressure is applied on the open-mouth bags (or they are extensively fingered), the bags may soften and lose their precise block shape.

In a preferred specific embodiment the filling machine comprises at least one compaction station with at least one compacting device for compacting the open-mouth bags filled with bulk materials. The compacting device comprises a container with a tubular inner wall and a takeup space for taking up a filled open-mouth bag. Furthermore a support unit on a height-displaceable lifting device is provided. The support unit is height-adjustable relative to the container in particular by means of the height-displaceable lifting device. The support unit is supported from beneath in a lowered position of the lifting device and in an elevated position it is suitable for taking over a filled open-mouth bag from an adjacent conveyor device. Furthermore comprised is a pressure plug that can be lowered from above which in a lowered position acts on the bulk material from above and in an elevated position, allows takeover of a filled open-mouth bag from an adjacent conveyor device.

This compaction station has many advantages. A considerable advantage of a filling machine having such a compaction station is that a filled open-mouth bag is compacted inside a container. This impresses the shape of the container on the open-mouth bag. Block-shaped, filled open-mouth bags can be manufactured showing a high degree of compaction.

In particular in a lowered position of the lifting device the support unit is supported or set down on support hooks of the container and supported from beneath. Some other support from beneath is likewise possible.

Preferably the container can be periodically lifted and lowered by one container travel by way of a compaction transmission. Periodic lifting and lowering of the container relative to the pressure plug ensures a ramming or jolting compaction of the bulk material filled in the open-mouth bag. The container travel is preferably less than one fifth and in particular less than one tenth of the length of the container. In particularly preferred configurations the container travel is less than 50 mm and in particular less than 20 mm and preferably less than 10 mm. A concrete configuration employs a travel of 6 mm. The stroke may be selected depending on the package size and in particular the package height and the desired degree of compaction and the compaction capacity of the bulk material.

The pressure plug is preferably driven pneumatically. The pneumatic drive may comprise at least one pneumatic cylinder. The compaction transmission is preferably driven via an electric motor. The combination of a pneumatic drive with another, for example electric, drive shows the advantage that the pneumatic drive can compensate pressure surges so as to reliably prevent overloading.

Another considerable advantage of a pneumatically operated pressure plug and a compaction transmission is that the pressure plug is automatically tracked as compaction increases (due to pneumatics). Even as compaction increases it is ensured that the acting force remains (virtually) the same. In the alternative it is also possible for the pressure plug to remain stationary and the container, to be raised and tracked pneumatically.

In advantageous configurations a dust-removal system is attached to the container. It is for example possible for the top container opening to be at least partially surrounded by a dust-removal opening. For example one side of the container or multiple sides of the container may be provided with dust-removal gaps where the top region of the container is sucked off and thus a majority of any escaping dust is reliably discharged.

In preferred configurations a top section of the container is designed cone-shaped or funnel-shaped or the like so as to facilitate inserting an open-mouth bag into the container.

In advantageous configurations a slider, pivot arm or the like is assigned to the compacting device, or the compacting device comprises a slider by means of which the filled open-mouth bag can be laterally pushed for example from the conveyor device onto, and/or off, the support unit. This allows the conveyor device to discharge an open-mouth bag intended for compaction and to compact it in the compaction station while the conveyor device per se continues running and for example transports another filled open-mouth bag to another compacting device of the compaction station. The parallel and concurrent compaction of multiple filled open-mouth bags may increase the processing speed concurrently with a long dwell time in the compaction station.

In all the configurations it is preferred for the slider to comprise suckers to keep the top bag wall open. Preferably the slider comprises suckers at different height levels for keeping open the top bag walls of open-mouth bags of different heights in a controlled manner.

In all the configurations it is possible for the support unit to be lifted by means of a short stroke device. As a compacted open-mouth bag is transferred from the support unit to the conveyor device this allows to position the support unit somewhat above the plane of the conveyor device so as to enable ease of pushing off the already compacted open-mouth bag onto the conveyor device. Reversely, the support unit may be placed slightly beneath the height level of the conveyor device to have the slider transfer an open-mouth bag intended for compaction from the conveyor device to the support unit. The short stroke device may for example perform a stroke of 5 mm or 10 mm or 20 mm or an intermediate amount. In the case of a 10 mm stroke there will preferably be a height difference of approximately 5 mm as the slider transfers an open-mouth bag intended for compaction from the conveyor device to the support unit and there is also a height difference of approximately 5 mm as thereafter, following compaction, the open-mouth bag is to be pushed back from the support unit to the conveyor device.

In all the configurations it is preferred for the pressure plug to be provided with a vacuum suction device.

In all the configurations it is preferred for the compaction station to comprise at least two compacting devices or three compacting devices or more compacting devices for compacting open-mouth bags filled with bulk materials. The compacting devices are preferably disposed in series and connected with one another via a conveyor device. This enables performing multiple compaction of a filled open-mouth bag. In particular it is also possible to operate multiple compacting devices, each simultaneously compacting one filled open-mouth bag, so as to obtain a correspondingly increased processing speed.

The compaction station carries out a method which serves to compact bulk material in an open-mouth bag filled with bulk material. A filled open-mouth bag is placed on a support unit. The support unit on which the filled open-mouth bag is placed is lowered into a tubular takeup space of a container far enough for the product level to be located within the tubular takeup space of the container. Then the support unit of the container rests on support hooks or is supported from beneath. Concurrently or preferably before this, a pressure plug dips from above into the open end of the open-mouth bag acting on the bulk material from above while the support unit (supported by the support hooks) presses against the bag bottom from beneath. The lifting device in particular travels downwardly and separates from the support unit as the support unit impacts on the support hooks.

The method allows an advantageous compaction of bulk materials in open-mouth bags, also allowing parallel actions to increase the performance of the entire system or a higher degree of compaction of the entire system with a given total performance.

A cleaning apparatus according to the invention serves to clean a tubular inner wall of a container used to receive an open-mouth bag in particular in a form-fit and/or a close fit. The inner container wall may e.g. be cleaned of bulk material particles adhering to the outer wall of the open-mouth bag or deposited on the tubular inner container wall during the filling process or during transport of the open-mouth bag. A cleaning device movable in the container along a longitudinal direction is comprised. The cleaning device comprises a laminate of multiple layers, the layers extending in the longitudinal direction or transverse or obliquely to the longitudinal direction. The laminate comprises two end faces, comprising a top surface and a bottom surface. The laminate shows a plurality of outwardly oriented fluid outlet ports for directing a fluid flow toward the tubular inner container wall.

The layers extend in particular in the longitudinal direction and/or transverse to the longitudinal direction.

In specific embodiments the cleaning apparatus comprises at least one feature as it has been described above with reference to the filling machine.

BRIEF DESCRIPTION OF THE DRAWINGS

Further advantages and features of the present invention can be taken from the exemplary embodiments which will be discussed below with reference to the enclosed figures.

The figures show in.

DETAILED DESCRIPTION

Figure 1:
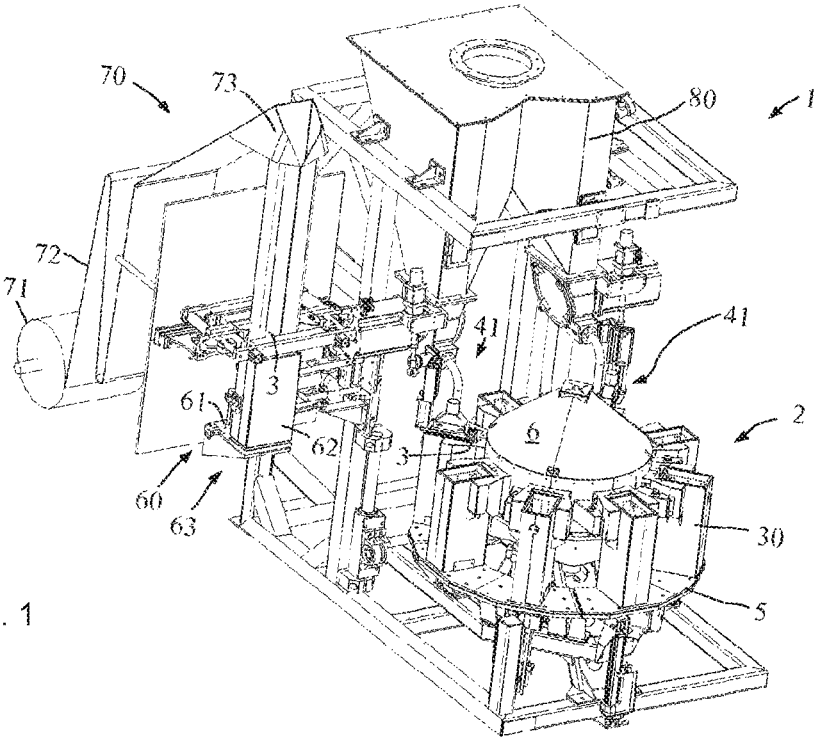
FIG. 1 a schematic perspective view of a filling apparatus for filling bulk materials into open-mouth bags.

FIG. 1 shows the basic structure of a filling machine 1. FIG. 1 shows a perspective total view of the filling machine 1 for filling bulk materials (and optionally fluids) into flexible open-top bags 3. The bags 3 provided for processing consist of a flexible material and in particular of a plastic material. The filling machine 1 comprises a filling carousel 2, a bag source 70 and an intermediate silo 80 for intermediate storing of the bulk goods intended for filling.

The bag source 70 provided is a film roll 71 on which a sheet of film 72 is wound. The sheet of film 72 unwound from the film roll 71 is fed to a shaping shoulder 73. There the sheet of film 72 consisting of a plastic film is guided around the shoulder and a longitudinal seam is welded so as to create a continuous tubular film.

The bag bottom is manufactured at the handover station 60 by making suitable welding seams transverse to the longitudinal extension of the tubular film. The tubular film having a suitable cross-section is conveyed and taken into the receiving box 62 of the handover station 60. The open bag 3 intended for filling is form-fittingly received there. For the feed the tubular film is cut to size so as to manufacture the open top end of the open bag.

It is also possible to manufacture the open-top bags from a prefabricated, e.g. extruded tubular film or alternately to feed completely prefabricated, flexible bags or sacks from a magazine or the like.

FIG. 1 illustrates the pivot position 63 of the handover station 60.

The apparatus or filling machine 1 comprises a basic frame to which the filling carousel 2 and the further components are attached. The part 5 of the apparatus is stationary while the part 6 rotates in operation. Each of the filling stations is provided with various handling stations wherein one handling station is provided for filling in high speed flow and another handling station 41, for filling in low speed flow. Further handling stations are provided for compacting the filled bulk material.

This filling carousel 2 is operated indexed. The required bulk material is supplied from the intermediate silo 80.

Figure 2:
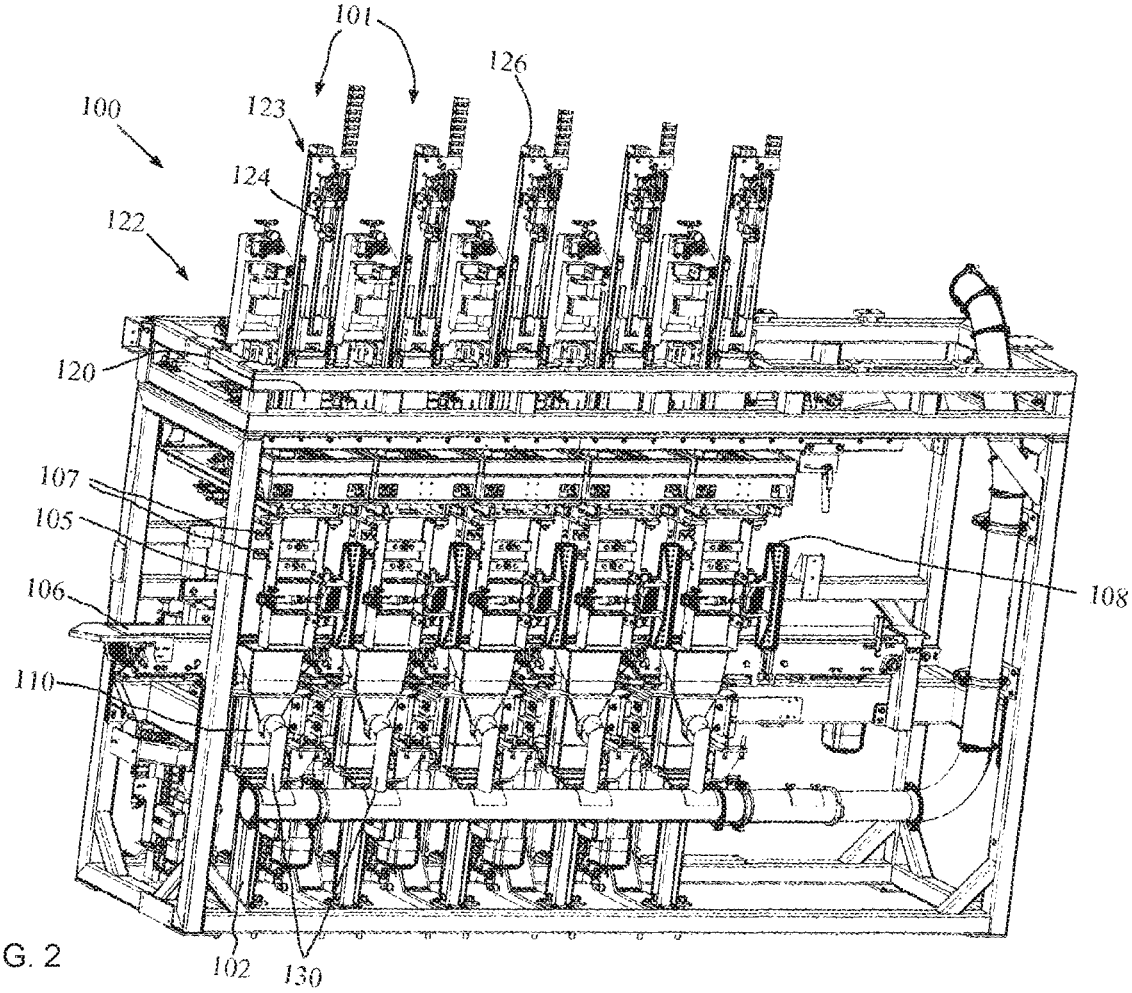
FIG. 2 a compaction station for compacting the open-mouth bags.

If the compacting achieved on the filling carousel 2 is not sufficient, a compaction station may be installed downstream, as it is illustrated in FIG. 2. The compaction station 100 of FIG. 2 comprises five different compacting devices 101 which are disposed connected in series.

Each compacting device 101 comprises a pressure device 123 with a pneumatic drive 124 each in the shape of one pneumatic cylinder. A pressure plug 120 can be lifted and lowered by means of a lifting and lowering unit 126. In the lowered position the pneumatic cylinder 124 then exerts pressure on the bulk material.

The filled open-mouth bags 3 are conveyed via the conveyor device 106 which is preferably a conveyor belt. If any of the compacting devices 101 is to perform compaction, the flap gate 108 is retracted or pivoted in for defined positioning of the open-mouth bag in the conveying direction, and the pertaining slider 105 is activated at a suitable time. Thus an open-mouth bag 3 intended for compaction is pulled off the conveyor device 106 and inserted into a container 110. Dust removal lines 130 are provided for removing dust during compaction. The lifting device 102 allows height-adjustment of a support unit 231, not visible in FIG. 2.

Figure 3:
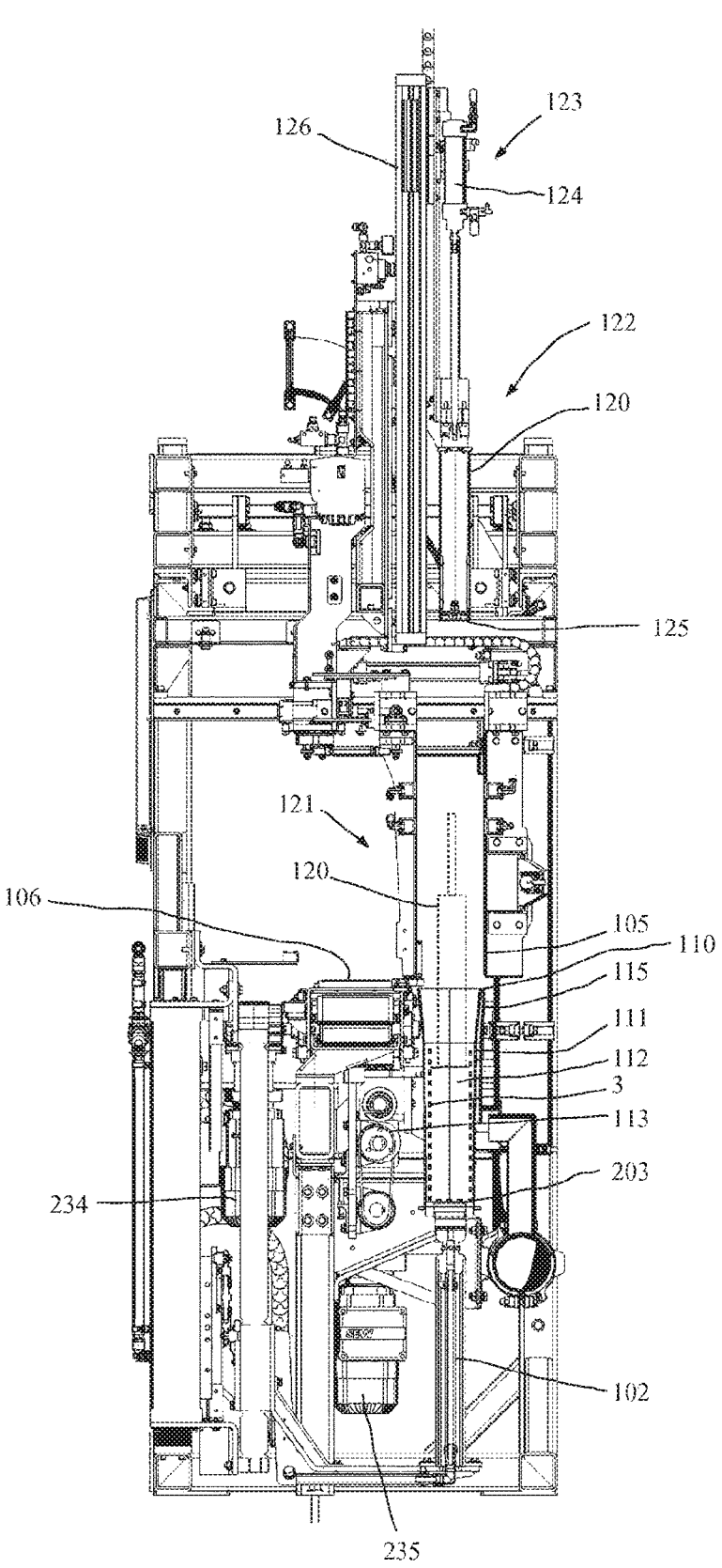
FIG. 3 a schematic cross-sectional view of the compaction station according to FIG. 2.

FIG. 3 shows a schematic cross section of the compaction station according to FIG. 2. The pressure device 123 with the pneumatic cylinder 124 can be recognized at the top end, followed downwardly by a linkage and then the pressure plug 120 coupled thereto. The pressing surface proper of the pressure plug 120 may be provided with a vacuum suction device 125 to provide effective deaeration. The vacuum suction device 125 allows to effectively suck air out of the bulk material.

The slider 105 is shown in the position above the container 110 which it has reached after the conveyor device 106 has transferred an open-mouth bag 3 intended for compaction to a support unit 131. The open-mouth bag 3 is shown in broken lines, as is a pressure plug 120 inserted into the open-mouth bag which is shown in broken lines in the lowered position 121. In the elevated position 104 the open-mouth bag 3 rests on the support unit 231 which is detachably coupled with the laminate 203 by magnets 232. When the lifting device 102 is in the lowered position 103, the support unit 231 rests on hooks 116 at the bottom end of the container 110. This uncouples the support unit 231 from the lifting device 102 since forces are carried off in the vertical direction from above onto the bulk material or the open-mouth bag directly via the hooks 116 and the container 110. The magnetic connection between the support unit 231 and the laminate 203 prevents the support unit 231 from canting against the tubular inner wall 111 during lowering. To ensure a good mechanical magnetic bond at all times, individual fluid outlet ports may be provided to exit e.g. at an oblique angle in the top plate or end plate for cleaning these from any particle deposits.

The laminate may consist of individual (and prior to mounting or manufacturing) separate plates forming a one-piece or multi-piece plate composite. It is also possible and preferred to have at least one portion of the laminate or the entire laminate on the whole formed integrally and e.g. manufactured by way of additive manufacturing and/or by 3D printing. Then the entire laminate may be manufactured in one manufacturing step. Guiding ducts or fluid passages may be manufactured e.g. by omitting material.

The container 110 has a tubular takeup space with a tubular inner wall 111. The cross section is rectangular so as to obtain block-shaped open-mouth bags.

The top section 115 of the container 110 is slightly conical to facilitate inserting an open-mouth bag intended for compaction.

Figure 4:
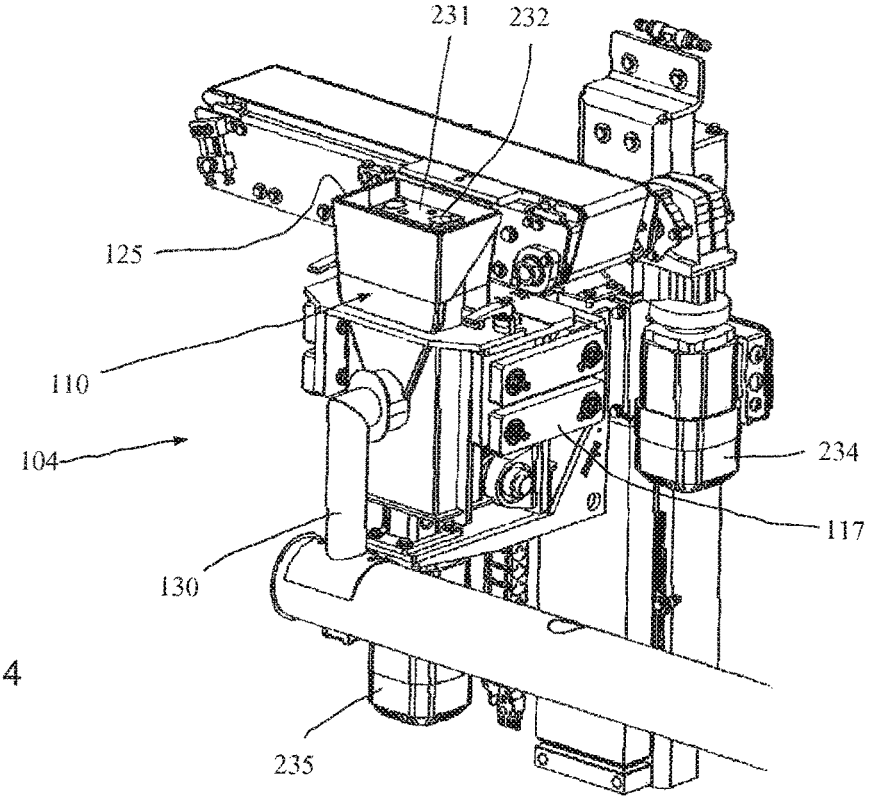
FIG. 4 a perspective view of a compacting device of the compaction station according to FIG. 2 in a first position.

FIG. 4 shows a perspective illustration of part of the compacting device 101. The laminate 203 with the magnets 232 is recognizable at the top end in the interior of the container 110 on which the support unit 231, not shown, rests in operation. A bag intended for compaction is set down on the support unit 231 respectively on a gliding plate (not shown) disposed thereon. Thereafter the open-mouth bag intended for compaction is lowered together with the support unit 231 so that the compacting device is transferred from the elevated position 104 illustrated in FIG. 4 to the lowered position 103 illustrated in FIG. 5.

The lower end of the open-bottom container 110 shows the support unit 231 which now rests on the hooks 116 of the container 110. This causes the lifting device 102 to decouple from the support unit 231. The lifting unit 102 is height-adjusted by way of the linear guide 233 which comprises a motor.

The motor 235 identifiable in FIG. 4 serves to drive the compaction transmission 113 which performs periodic ramming movements of the entire container 110.

To cause the lifting movement of the container 110 to decouple from the dust-removal system 130 the dust removal system 130 is decoupled from the container 110. This is done for example by receiving the dust removal system 130 in an elongated hole 131 at the container 110 so as to enable sufficient vertical offset. The elongated hole is sealed by way of a rubber flap.

Figure 5:
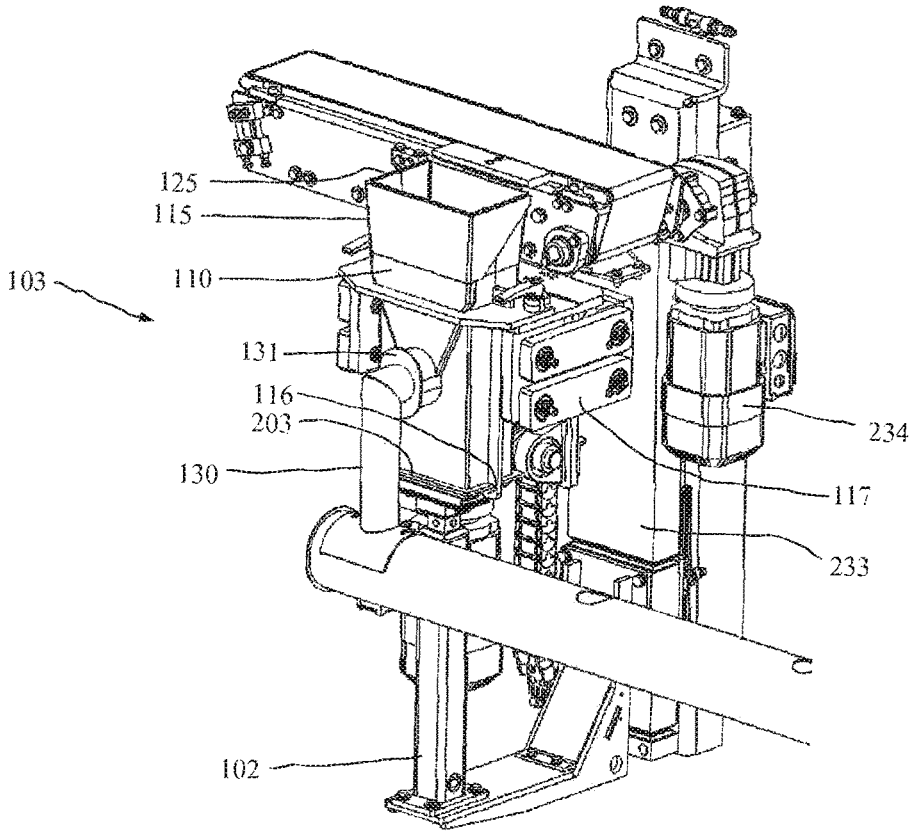
FIG. 5 the compacting device of FIG. 4 in a second position.

The motor 234 identifiable in FIGS. 4 and 5 serves to drive the conveyor belt 106.

Figure 6:
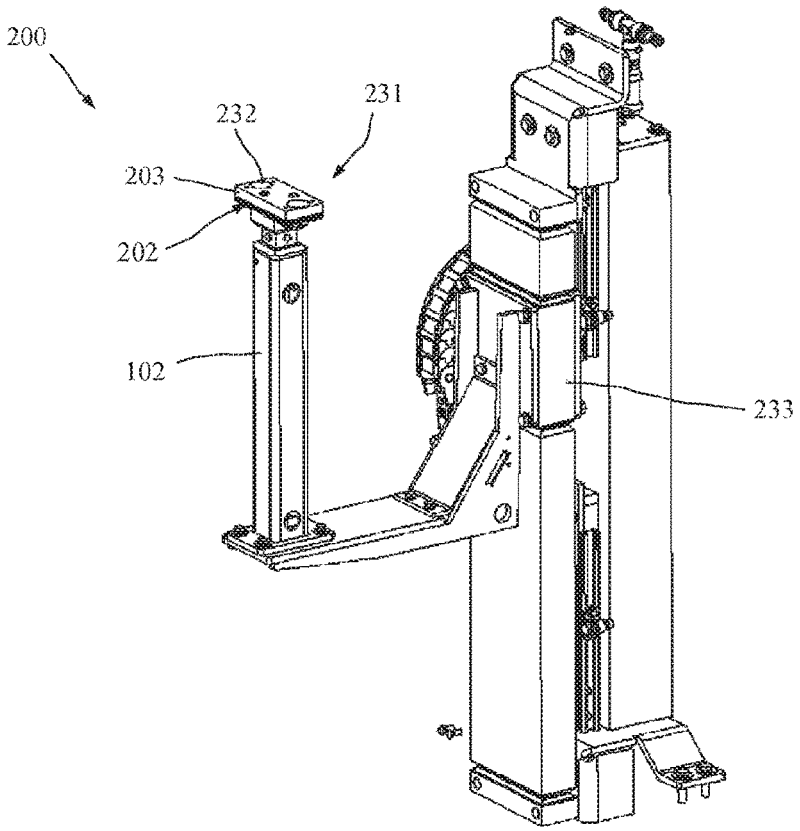
FIG. 6 a cleaning apparatus for cleaning the container of the compacting device of FIG. 4.

FIG. 6 shows a part of the compaction station 100 respectively the cleaning apparatus 200, with which the inner wall 111 of the container 110 can be effectively cleaned already when discharging a compacted open-mouth bag 3 from the container 110. The cleaning device 202 with the laminate 203 is used therefor.

Figure 7:
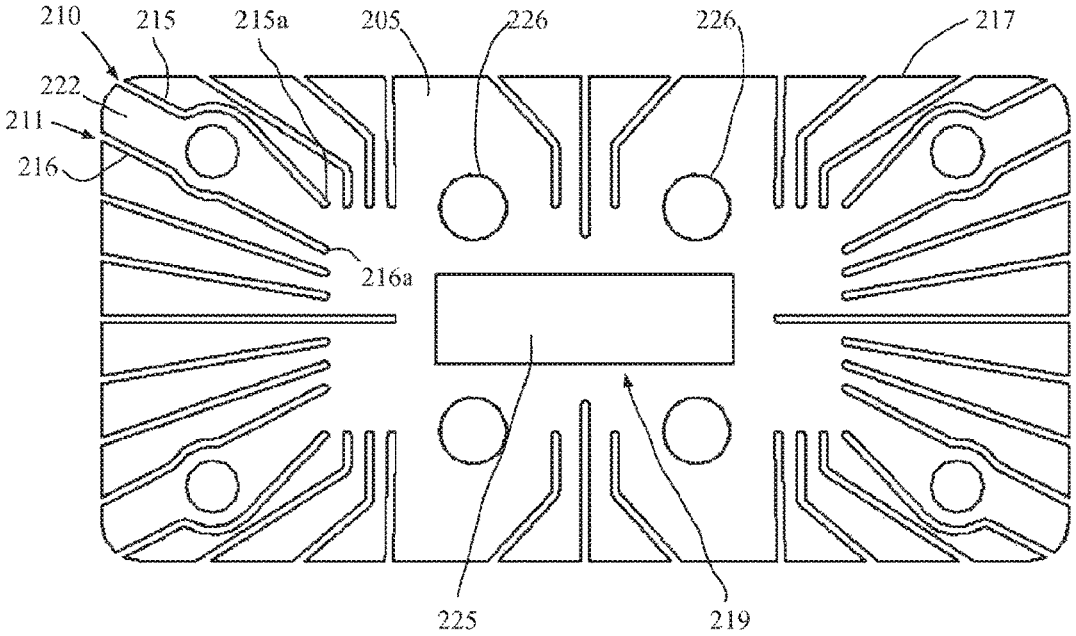
FIG. 7 a plate of the plate composite of the cleaning apparatus according to FIG. 6.
Figure 8:
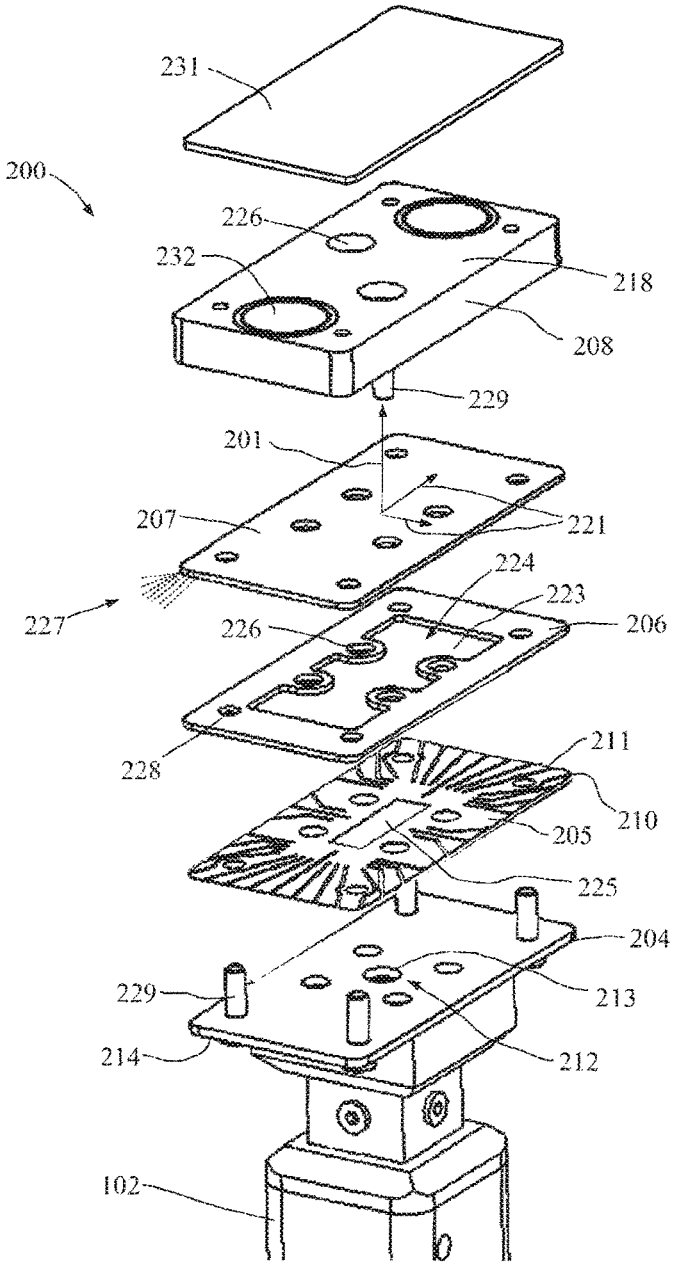
FIG. 8 an exploded view of the plate composite of the cleaning apparatus according to FIG. 6.

The laminate 203 comprises multiple layers 204 to 208 whose structure and function will be discussed below with reference to the FIGS. 7 and 8. FIG. 7 shows a plan view of the fluid guiding layer in particular in the shape of a fluid baffle 205, while FIG. 8 shows a schematic exploded view of the laminate respectively plate composite 203.

The cleaning apparatus 200 can be lifted and lowered by means of the lifting device 102. The laminate 203 comprises for the bottommost plate an end plate 204 configured as a bottom layer or bottom plate. The fluid feed 212 is connected with the bottom plate 204 through a fluid feed port 213. Centering pins 229 and/or screws hold the entire laminate 203 together when mounted.

Brushes may optionally be attached to or configured on one or more of the plates or layers 204-208 to assist with cleaning the inner wall.

Above the bottom plate 204 there is the fluid baffle 205 on which a plurality of fluid outlet ports 210, 211 is configured distributed over the circumference.

The fluid outlet ports 210, 211 form the ends of the guiding ducts 215, 216 which extend from a radially inwardly region 219 up to the outside surface 220 or the outer edge on the peripheral surface 217. These guiding ducts 215, 216 are configured as recesses or through hole in the fluid baffle 205. The respective guiding ducts 215, 216 are separated from one another by material bridges 222. Basically, all the guiding ducts 215, 216 substantially extend in a star layout so that as to obtain fluid outlet ports distributed over the entire circumference which serve in particular as blowout holes for blowing out air for a cleaning medium. In the fluid baffle 205 there is a central through hole 225 which has no immediate connection whatever with the guiding ducts of the fluid baffle 205.

Above the fluid baffle 205 a distance plate 206 is used having a distributor trough 223 (distributor space) which is presently configured as a through hole in the distance plate 26. The fluid (presently air) intended for distribution is distributed through the distributor trough 223 to all the guiding ducts 215, 216 so that air is blown outwardly from all the guiding ducts 215, 216 via the air supply through the central fluid feed port 213. The intensity of the blown-out air can be controlled by means of the cross-sectional areas of each of the guiding ducts.

It is possible to configure separate supply feed-throughs 226 which allow to realize supply to further components. Vacuum may for example be passed through the supply feed-through 226. Or compressed air is passed through. It is also possible to pass electric or sensor signals through the supply feed-throughs 226.

A top plate 207 is also provided above the distance plate 206 which is finally followed by the end plate 208.

The cleaning apparatus 200 may optionally comprise only one plate composite or laminate for example of three plates or layers with the center layer or plate configured e.g. as a fluid baffle. In all the cases the guiding ducts in the fluid baffle may be configured as through holes. Alternately it is possible for the guiding ducts for example to be milled into the surface of the fluid baffle.

Additional functions may be integrated in the topmost plate 208. Thus for example one or more magnet(s) 232 may be provided or further actuators may be attached, such as e.g. a short stroke device 140 controlled by means of supply feed-throughs 226.

A cleaning apparatus 200 may be used accordingly also for cleaning the receiving boxes 30 or 62 of the filling machine 1. Thus, each bag exchange may be followed by automatic cleaning of the receiving boxes 30 and/or 62.

The compaction station enables to considerably enhance compaction of the bulk material filled into an open bag. It is possible to provide a compaction station with multiple compacting devices disposed in series so as to enable parallel operation and parallel compaction of a plurality of filled open-mouth bags. A slider or the like may push an open-mouth bag intended for compaction from a conveyor device such as a flat belt conveyor toward the compacting device. The compaction proper is performed in the container with the tubular inner wall, wherein a pressure plug is lowered from above and inserted into the open-top open-mouth bag while the bottom of the open-mouth bag is supported by means of a support unit on container hooks. Concurrently the container ambience can be sucked off by a dust removal system.

During pressing with the pressure plug the container may perform periodic lifting and lowering movements which considerably assist in the compaction process. Simultaneously the pressure plug can suck off air. To this end the contact surface of the pressure plug may for example consist of a wire netting or wire mesh through which suction is possible.

In the case that dust escapes during the compaction process the integrated cleaning apparatus may clean the inner container 100 wall from adhering bulk material particles. This is what the laminate 203 of the cleaning device 202 serves for, with a plurality of fluid outlet ports 210, 211 configured on the peripheral surface 217 of the plate composite 203 through which a fluid flow can be directed toward the inner container wall.

Controlling the air passages may be simple, by an appropriate configuration of the fluid baffle wherein the intensity can be set and adjusted accordingly by adapting the cross section or the quantity of outlet ports 210, 211 in relation to the peripheral length. The orientation of the air outlet 210, 211 defines the flow direction of the fluid and thus the direction of the fluid flow 209.

If further devices also intended to be controlled are provided for example above the plate composite 203, a supply feed-through 226 may be formed at the laminate to allow for example a compressed air or vacuum connection or a compressed air or vacuum passage.

Since as a rule the outer dimensions of the plate composite are matched to the inner dimensions of the container 110, a supply feed-through 226 allows to realize ease of media exchange or data exchange.

The structure of the compaction station 100 and the structure of the cleaning apparatus 200 can be realized easily and inexpensively.

Figure 9:
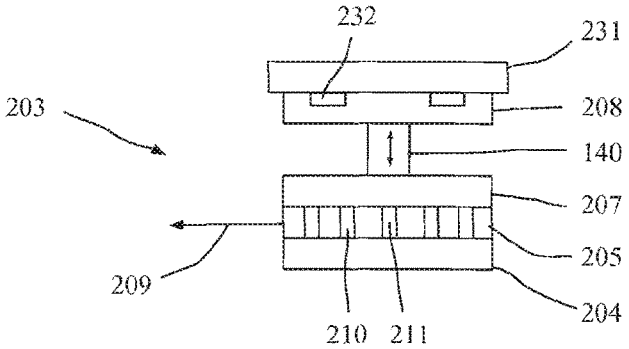
FIG. 9 a schematic side view of a detail of a lifting device.

FIG. 9 shows a detail of a lifting device 102 with a short stroke device 140 attached to the laminate 203 provided for adjusting the height of the plate 208 by +/−5 mm. This will also adjust the support unit 231 accordingly. The short stroke device 140 might also be integrated in the linear guide 233.

The laminate 203 presently comprises the layers 204, 205 and 207. The fluid baffle 205 where the fluid outlet ports 210, 211 are configured is received between the layers 204 and 207. The fluid outlet ports are cut out of the plate 205 e.g. by water jet cutting. The plate 207 accommodates the short stroke device 140 which allows to (slightly) adjust the height of the plate 208 to facilitate handover of an open-mouth bag from the conveyor device or to the conveyor device 106. The open-mouth bag rests on the support unit 231 which is magnetically, and thus detachably, attached to the plate 208.

While a particular embodiment of the present filling machine for filling open bags with bulk material and cleaning device has been described herein, it will be appreciated by those skilled in the art that changes and modifications may be made thereto without departing from the invention in its broader aspects and as set forth in the following claims.

LIST OF REFERENCE NUMERALS

1 filling machine
2 filling carousel
3 open-mouth bag
5 stationary part
6 movable part
30 receiving box
41 handling station
60 handover station
61 pivot arm
62 receiving box
63 pivot position
70 bag source
71 film roll
72 sheet of film
73 shaping shoulder
80 intermediate silo
100 compaction station
101 compacting device
102 lifting device
103 lowered position of 102
104 elevated position of 102
105 slider
106 conveyor belt
107 sucker at 105
108 flap gate
110 container
111 tubular inner wall
112 takeup space
113 compaction transmission
115 top section of 110
116 hook
117 vibrator suspension
120 pressure plug
121 lowered position
122 elevated position
123 pressure device
124 pneumatic drive
125 vacuum suction device at 110
126 lifting and lowering unit
131 elongated hole
130 dust removal system
140 short stroke device, short stroke cylinder
200 cleaning apparatus
201 longitudinal direction
202 cleaning device
203 laminate
204 layer, end layer, bottom layer
205 layer, fluid guiding layer
206 layer, distance layer
207 layer, top layer
208 layer, end layer
209 fluid flow
210 fluid outlet port
211 fluid outlet port
212 fluid feed
213 fluid feed port
214 end face, bottom surface
215 guiding duct
**215*a*** guiding duct front end
216 guiding duct
**216*a*** guiding duct front end
217 peripheral surface
218 end face, bottom surface
219 radially inwardly region
221 transverse direction
222 material bridge
223 distributor trough in 206
224 through hole in 206
225 central through hole of 205
226 supply feed-through
227 brush
228 centering hole
229 centering pin
230 drive
231 support unit
232 magnet
233 linear guide with drive
234 motor
235 motor

The invention claimed is:

1. A filling machine for filling open-mouth bags with bulk material wherein the open-mouth bag is at least temporarily received in a container and comprising:

a cleaning apparatus for cleaning a tubular inner wall of the container of particles of the bulk material for cleaning the tubular inner wall after or during discharge and/or prior to or during inserting an open-mouth bag, the cleaning apparatus comprising a cleaning device that is movable in the container along a longitudinal direction;

wherein the cleaning device comprises a laminate of a multitude of layers;

wherein the laminate comprises a first end face and a second end face, the first end face configured as a top surface and the second end face as a bottom surface; and wherein the laminate is configured with a plurality of outwardly oriented fluid outlet ports for directing a fluid flow toward the tubular inner wall of the container.

2. The filling machine according to claim 1, wherein at least one fluid feed is connected with an end layer.

3. The filling machine according to claim 1, wherein the layers extend transverse to the longitudinal direction and wherein a plate composite comprises a first end layer with a first end face, and a second end layer with a second end face, wherein the first end layer is configured as a top layer with a top surface and the second end layer as a bottom layer with a bottom surface.

4. The filling machine according to claim 1, wherein the cleaning device is displaceable in the longitudinal direction for cleaning the tubular inner wall of the container and/or lifting out the open-mouth bag.

5. The filling machine according to claim 1, wherein fluid outlet ports are configured on a peripheral surface and/or at least on one end face of the laminate.

6. The filling machine according to claim 1, wherein the laminate comprises at least one fluid guiding layer (air baffle) in which a multitude of guiding ducts is configured which are coupled with fluid outlet ports.

7. The filling machine according to claim 6, wherein the guiding ducts are separated from one another by material bridges of the fluid guiding layer and extend outwardly from a radially inwardly region up to the outer edge of the fluid guiding layer.

8. The filling machine according to claim 7, wherein at least two guiding ducts extend from one radially farther inwardly guiding duct front end up to one fluid outlet port each.

9. The filling machine according to claim 1, wherein the laminate comprises a distance plate adjacent to the fluid guiding layer.

10. The filling machine according to claim 8, wherein a distributor trough is configured in the laminate by means of which the at least two guiding duct front ends are connected with one another.

11. The filling machine according to claim 10, wherein the distributor trough is formed by a through hole in the distance layer.

12. The filling machine according to claim 10, wherein the distributor trough is connected with the fluid feed.

13. The filling machine according to claim 1, wherein a fluid baffle includes a central through hole.

14. The filling machine according to claim 1, wherein a drive is provided for moving the laminate along a longitudinal direction of the tubular inner wall of the container.

15. The filling machine according to claim 1, wherein the laminate is configured with at least one supply feed-through.

16. The filling machine according to claim 1, wherein brushes are attached to an outside surface of the plate composite for cleaning the tubular inner wall.

17. The filling machine according to claim 1, wherein at least one plate of a plate composite is configured with at least one centering hole in which a centering pin is received.

18. The filling machine according to claim 1, wherein at least one plate of a plate composite consists at least substantially of metal.

19. The filling machine according to claim 1, wherein the cross section of a plate composite is matched to the inner cross section of the container, the cross section being configured for example round, rounded, oval, rectangular, undercut or star-shaped.

20. The filling machine according to claim 1, wherein the laminate comprises at least one plate.

21. The filling machine according to claim 20, wherein the laminate is designed as a plate composite and comprises multiple plates.

* * * * *